United States Patent [19]

Adcock

[11] 4,212,359

[45] Jul. 15, 1980

[54] DOWNHOLE WEIGHT CONTROL DEVICE FOR IMPACT ROCK DRILLING TOOL

[76] Inventor: Gerald L. Adcock, 511 Airway Dr., Lewiston, Id. 83501

[21] Appl. No.: 864,780

[22] Filed: Dec. 27, 1977

[51] Int. Cl.[2] ..... E21B 17/04

[52] U.S. Cl. ..... 175/26; 175/94; 175/321

[58] Field of Search ..... 173/10, 15; 175/26, 175/94, 321, 293, 296, 232

[56] References Cited

U.S. PATENT DOCUMENTS

| | | | |
|---|---|---|---|
| 2,684,835 | 7/1954 | Moore | 175/321 |
| 3,198,264 | 8/1965 | Oelke et al. | 173/78 |
| 3,463,252 | 8/1969 | Miller et al. | 175/321 X |
| 3,815,692 | 6/1974 | Varley | 175/321 |
| 3,858,188 | 12/1974 | Vasiliev et al. | 175/321 |

*Primary Examiner*—William F. Pate, III

*Attorney, Agent, or Firm*—Wells, St. John & Roberts

[57] ABSTRACT

A downhole weight control device is described for connecting to the upper end of a downhole, pneumatically-operated, impact rock drilling tool for applying a downward force on the tool sufficient to maintain the drill bit in the closed working position. The weight control device has a piston member that has an effective area related to the surface area of the hammer piston in the drilling tool to effectively counterbalance an upward force of the tool tending to lift the tool. The control device also prevents exerting excessive weight on the drill bit. The control device has means for automatically decreasing the working pressure should the drill string be fed for a period of time at a rate greater than the penetration rate of the tool.

7 Claims, 4 Drawing Figures

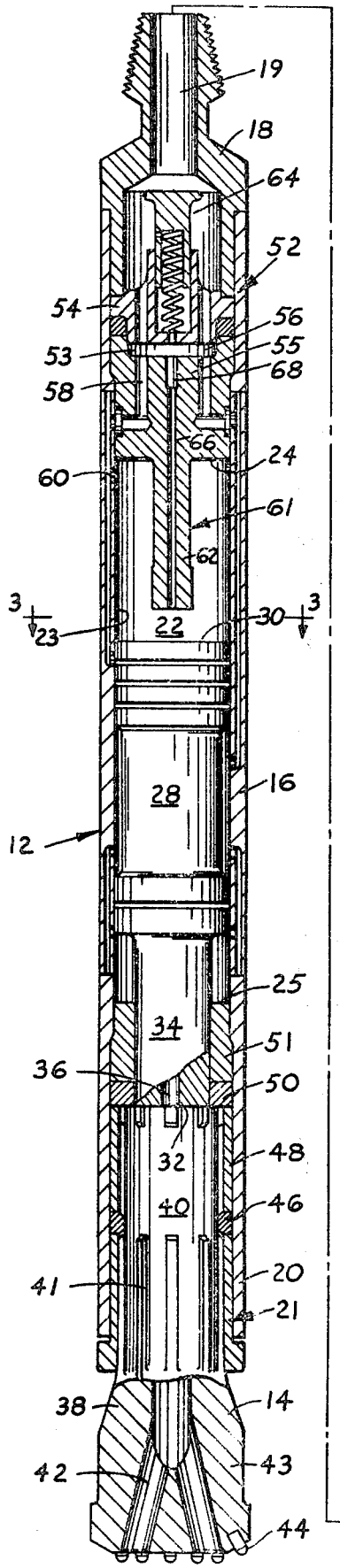
FIG. 2
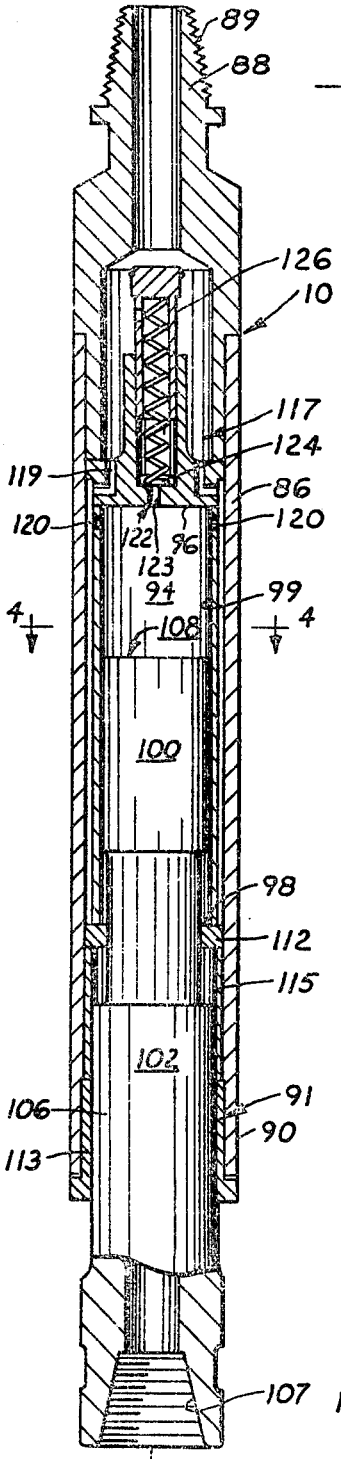
FIG. 1
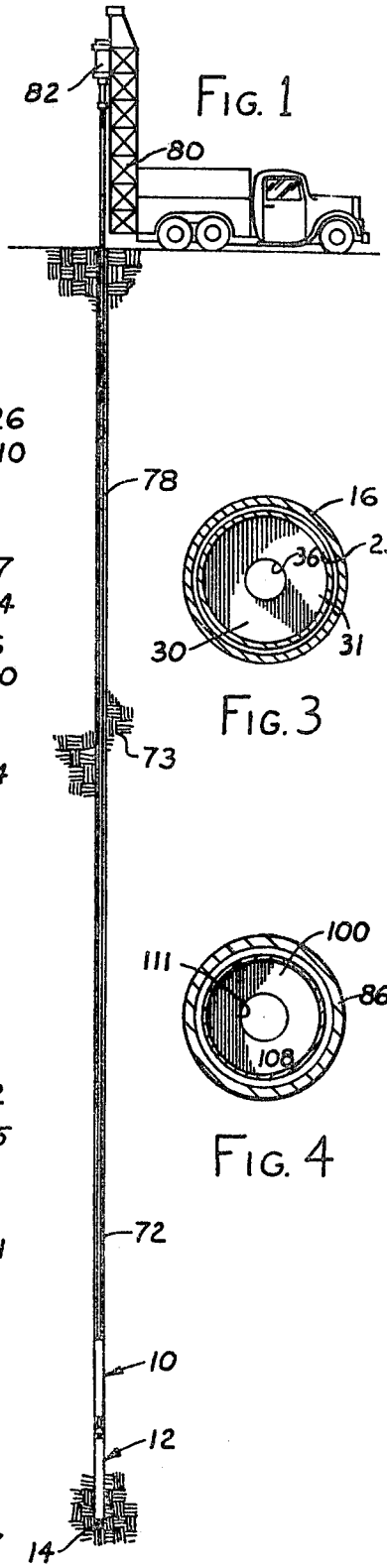
FIG. 3
FIG. 4

DOWNHOLE WEIGHT CONTROL DEVICE FOR IMPACT ROCK DRILLING TOOL

BACKGROUND OF THE INVENTION

This invention relates to downhole, pneumatically-operated, impact drilling tools and more particularly to devices for controlling the weight applied to the drilling tools during operation.

To obtain optimum penetration rate, it is necessary for the impact drilling tool to be weighted to maintain the drilling bit in the closed working position within the drilling tool. However, if excessive weight is placed upon the tool, excessive wear and breakage of the tool bit generally results.

Most impact rock drilling tool manufacturers recommend that the weight applied to the tool exceed a minimum weight to keep the tool closed when the bit is in the drilling position but not to exceed a maximum weight which results in shortened bit life. Most manufacturers indicate that an optimum total weight on the tool lies between the minimum and maximum and must be determined by experience. However, in reality, it is relatively difficult to control the weight applied to the tool particularly in relatively deep holes and for changing working pressures. As the working pressure varies, the weight applied to the tool should additionally vary so as to not overload the drill bit. Additionally, constant observation by an operator at the drill rig is a very time-consuming and fatiguing operation. Even with the most experienced operator it is very easy to overload the tool particularly in deep holes, resulting in excessive wear at the drill bit.

Attempts have been made to place a known weight of drill pipe on top of the tool to preload the tool with a telescoping fixture interconnecting the preload drill pipe and the drill string so that a constant load is maintained on the tool. However, with such a system the operator must be able to accurately calculate the necessary preload required. Furthermore, such a system does not accommodate itself to varying working pressures that may be experienced particularly in deep hole drilling. Furthermore, such a system does not overcome the varying friction forces between the preload drill pipe and the hole wall.

One of the principal objects of this invention is to provide a downhole weight control device adjacent the tool for applying a proper preload weight on the tool that is automatically varied in proportion to the working pressure.

An additional object of this invention is to provide a downhole weight control device for applying the correct preload to the tool to maintain the drilling tool in the closed working condition without additionally overloading the drill tool causing excessive wear.

A further object of this invention is to provide a downhole weight control device for attaching to a downhole, pneumatically-operated, impact drilling tool for providing a preload on the tool that maintains the tool operating at optimum penetrating rate without causing excessive wear or breakage of the drill bit.

A still further object of this invention is to provide a downhole weight control device for a downhole, pneumatically-operated, impact drilling tool that increases the life of the tool, drilling bit, drill string, drill swivel, drill rotary table and power heads.

An additional object of this invention is to provide a downhole weight control device for a downhole, pneumatically-operated, impact drilling tool that is capable of optimizing the penetration rate of the tool to obtain straighter holes while still at the same time extending the life of the drill bit.

A further object of this invention is to provide a downhole weight control device for an impact drilling tool that applies the correct preload on the tool regardless of the working air pressure.

A still further object of this invention is to provide a weight control device for an impact drilling tool that provides the correct preload to the tool to obtain optimum penetration rate while at the same time preventing transmission of normal vibrations back up the hole through the drill string.

These and other objects and advantages of this invention will become apparent upon reading of the following detailed description of a preferred embodiment.

BRIEF DESCRIPTION OF THE DRAWINGS

A preferred embodiment of this invention is illustrated in the accompanying drawings, in which:

FIG. 1 is a diagrammatical view partly in cross section illustrating the employment of the subject downhole weight control device to a downhole pneumatically-operated, impact drilling tool;

FIG. 2 is an enlarged vertical cross-sectional view of a downhole weight control device embodying the principal features of this invention and a conventional, pneumatically-operated, impact drilling tool;

FIG. 3 is a cross-sectional view taken along line 3—3 in FIG. 2; and

FIG. 4 is a cross-sectional view taken along line 4—4 in FIG. 2.

DETAILED DESCRIPTION OF A PREFERRED EMBODIMENT

Referring now in detail to the drawings, there is illustrated in FIGS. 1 and 2 a downhole weight control device generally designated with the numeral 10 for providing a weight or preload on a downhole, pneumatically-operated impact rock drilling tool 12. The drilling tool 12 has a drilling bit 14 attached thereto for penetrating an earth formation 73 as illustrated in FIG. 1.

The impact drilling tool 12 illustrated in FIG. 2 is of a conventional design presently on the market. This invention is not limited to any particular type of downhole, pneumatically-operated, impact rock drilling tool. However, for purposes of understanding this invention it is desirable to be familiar with the major components of such a tool and its normal operation.

The impact drilling tool 12 has a cylindrical housing 16 extending from an upper end or backhead 18 to a lower end 20 having a drilling bit chuck 21 for receiving the drill bit 14. The upper end 18 has an air intake 19 for normally receiving air at a desired working pressure from a drill string 78 that extends uphole to an above hole air source means such as a compressor.

The cylindrical housing 16 includes an enclosed internal cylindrical chamber 22 having a cylindrical wall 23 extending from an upper chamber end 24 to a lower chamber end 25.

An important feature of the drilling tool 12 is a freely movable hammer piston 28 that is freely mounted within the cylindrical chamber 22 for movement in a reciprocating motion from the upper chamber end 24 to the lower chamber end 25 and against the drill bit 14 to impact against the drill bit 14 and transmit an impact force pulse through the drilling bit 14 to the bottom of the hole to fracture the earth formation to enable the tool to increase the depth of the hole 72. The hammer piston 28 includes an upper end 30 having a face surface 31 (FIG. 3) of a preset or known surface area. The hammer piston 28 includes a lower end 32 that is formed with a reduced stem 34 for striking the drill bit 14. The hammer piston 28 includes a central bore 36 extending therethrough to the drill bit 14 for discharging air through the drilling tool to the drill bit 14.

The drill bit 14 has an elongated body 38 having an upper anvil portion 40 and an enlarged lower bit portion 43. Splines 41 are formed on the side of the elongated body for complementary engagement with the chuck 21 to cause the drill bit 14 to rotate with the rotation of the tool 12. Air passages 42 are formed through the elongated body 38 in communication with the central bore 36 to enable air to pass through the bit 14 to flush the earth particles from the bottom of the hole upward alongside the drill tool to continually cleanse the bottom of the hole. The enlarged bit portion 43 generally has carbide buttons or cutters 44 formed or attached thereto for cutting the earth formation.

The chuck 21 includes a retaining ring 46 for securing the drill bit therein and enabling the drill bit 14 to move in a limited reciprocal fashion from a closed working condition illustrated in FIG. 1 to an extended nonworking position in which the drill bit 14 engages retaining ring 46. The chuck 21 includes a threaded chuck body 41 that is complementary to the splines 41 for securing the drill bit 14 to the lower end 20 of the tool 12. The chuck 21 includes a spacer 48 that extends along the elongated body 38 for supporting a bearing washer 50 and piston bearing assembly 51. The piston bearing 51 slidably supports the reduced stem 34 of the piston 28.

The tool 12 includes a tool air supply means 52 for supplying air to the cylindrical chamber 22 at the working pressure from the intake 19. The air supply means 52 includes a main air feed valve 53 that is formed by a valve chest 54 and a valve seat 55. The valve 53 includes a valve disk 56 formed therein for permitting air to flow from the air intake 19 through main air passages 58 to the cylindrical chamber 22. The main air passageways 58 include ports 60 formed in the cylindrical wall 23 for emitting the air into the internal cylindrical chamber 22. The ports 60 are adjacent the upper end 24 of the chamber 22.

The tool 12 further includes an exhaust valve 61 that includes a valve guide 62 that extends from the valve seat 55 downward into the cylindrical chamber 22 complementary to the central bore 36. When the piston 28 moves upwardly the piston moves over the valve guide 62 with the valve guide 62 extending into the central bore 36 to prevent air from passing from the chamber 22 through the central bore 36. When the piston is driven downwardly the upper end 30 eventually uncovers the valve guide 62 enabling the air within the chamber 22 to exhaust through the central bore 36.

The tool 12 further includes a check valve 64 to close the intake 19 should the pressure within the tool exceed the working pressure from the drill string. Additionally, the tool includes a bleed passageway 66 that extends from the intake through the valve seat and disk valve 56 for bleeding purging air into the central bore 36 to maintain sufficient pressure within the tool to prevent water, mud or dirt from passing into the tool through the air passages 42 in the drill bit 14. A choke valve 68 is formed in the bleed passageway 66 to limit the amount of air that is bled from the intake through the bleed passageway 66.

During normal operation of the tool 12, it is positioned down a hole 72 in an earth formation 73 with a drill bit 14 engaging the hole bottom 75. The tool 12 is normally attached to the bottom of a drill string 78 that extends downward in the hole 72 from a drill rig 80 that is positioned at the surface level adjacent the hole entrance. Frequently the drill rig 80 includes a drill string support and feed mechanism 82 on the drill rig 80 for supporting the drill string and feeding the drill string downward as the tool penetrates the earth formation.

Conventionally the drill string support and feed mechanism 82 is utilized as a means for providing a load on the tool 12 to counteract an upward force on the tool to maintain the drill bit 14 in the closed working condition. However, as previously mentioned it is very difficult to maintain an accurate load on the tool from the drill rig, particularly if the hole is of considerable depth.

The purpose of the downhole weight control device 10 is to overcome such objections. The weight control device 10 is mounted between the drill string 78 and the tool 12 for applying a predetermined load on the tool that is responsive to the working pressure applied to the tool 12 to maintain the drill bit 14 in the closed working condition when the tool is at the bottom of the hole 72.

The weight control device 10 includes an elongated cylindrical casing member 86 with an upper end or backhead 88 having a connecting means 89 for attaching to the lower end of the drill string 78. The casing member 86 extends downward to a lower end 90 having a chuck 91. The casing member 86 has an elongated cylindrical cavity 94 with a cylindrical cavity wall 99 extending from the upper end 96 to a lower end 98.

The weight control device 10 includes a weight control piston member 100 that is slidably mounted within the cylindrical cavity 94 for movement between an upper extreme position adjacent the upper end 96 to a lower extreme position adjacent the lower end 98. The piston member 100 includes a rod 102 that extends from the lower end 90 of the casing member 86. The rod 102 has connecting means 107 that is complementary to the backhead 18 for attaching the rod 102 to the tool housing 16. The connecting means rod 102 and piston member 100 are preferably formed as an integral component. The rod portion 102 includes a spline 106 for mating with a complementary portion of the chuck 91.

The piston member 100 includes an upper face surface 108 that has an effective surface area that corresponds with the surface area of face surface 31 of the hammer piston 28. The piston member 100 includes a central bore 111 that extends from the upper end surface 108 downwardly through the rod 102. The piston member 100 is supported within the cylindrical cavity by retaining ring 112. The chuck 91 includes a chuck body 113 that has a complementary section to the spline 106 for retaining the piston member 100 within the cylindrical cavity. The chuck body 113, in combination with the spline 106, causes the piston member to rotate about the longitudinal axis in response to the rotation of the casing member 86 to transfer the rotational movement from the drill string 78 to the tool 12. The chuck 91 further includes a spacer block 115 that extends from the chuck body to the retaining ring 112 to removably support the retaining ring 112 within the casing member 86. In a preferred embodiment the central bore 111 is complementary to the central bore 36 of the free movable hammer piston 28 so that there is no substantial pressure drop in the air as it passes through the weight control device 10 to the tool 12.

The weight control device 10 includes a device air supply means 117 that provides air at the working pressure from the drill string 78 to the cylindrical cavity 94. The air supply means 117 includes main passageways 119 that extend from the upper end 88 downwardly and into the cylindrical cavity 94 through main ports 120 formed in the wall 99 adjacent the upper end 96. When the piston member 100 is in the upper extreme position the piston member covers the main ports 120 shutting off the main air flow to form an automatic means for decreasing the air pressure to the hammer piston 28 and to the piston member 100.

The weight control device 10 further includes means 122 for bleeding air into the cylindrical cavity 94 and through the central bore 111 when the piston member is in the upper extreme position covering the main ports 120. The bleed means 122 includes a bleed port 123 formed in the upper end 96 to bleed air through a choke valve 124 into the cylindrical cavity 94. Additionally, the weight control device 10 includes a check valve 126 formed in the upper end 88 for closing the intake to the weight control device 100 should the pressure in the drill string rapidly drop, to prevent water or mud from backing up through the tool 12 into the weight control device 10.

During operation of the weight control device 100, the backhead 18 of the tool is threaded into the connecting means 107 of the weight control device 100. The upper end or backhead 88 of the weight control device 10 is then attached to the bottom of the drill string 78. The drill string with the tool 12 and device 10 attached is then positioned in the hole. After the tool 12 is at the bottom of the hole 72, the working pressure is applied to the system with the air being supplied through the weight control device 10 to the tool 12. As the working pressure is applied to the internal chamber 22 an upward force is created and applied to the cylindrical housing 16 tending to raise the tool. The upward force equals the product of the area of the face surface 31 of the hammer piston 28 and the working pressure. For example, if the working pressure is 180 psi and the hammer piston 28 has an exterior OD of $5\frac{7}{8}''$ and an interior ID (central bore 36) of $1\frac{1}{2}''$, then the resultant upward force would be in the neighborhood of 4,560 pounds ($180\ lb/in.^2 \times 25.329\ in.^2$). Such upward force varies in direct proportion to the working pressure applied to the tool. To maintain the drill bit 14 in the closed working position it is necessary to preload the tool 12 with the downward force in excess of the upward force.

Consequently, the weight control device 10 is designed so that a force is created and directed downwardly on the tool 12 of a magnitude greater than 4,560 pounds. It is preferable that a slight excess load be applied of less than 200 lbs. so that a very small positive pressure is applied to the drill bit 14 over and above that necessary to overcome the upward force. A large excess weight would cause excessive wear and possible breakage of the drill bit.

If the drill hole 72 is formed substantially horizontal, then one can discount the weight of the cylindrical housing 16 and the weight of the piston member 100 and rod 102 in calculating the total load required. Consequently, in a horizontal drilling operation the upper face surface 108 of the piston member 100 should have a surface area substantially equal to the hammer piston surface 31. In this example, that would be approximately 25.329 sq. inches or slightly larger to create a downward pressure on the piston member (assuming a working pressure of 180 psi) of at least 4,560 pounds but preferably less than 4,760 pounds.

In a vertical drilling arrangement one would need to take into consideration the weight of the cylindrical housing 16 (not including the weight of the hammer piston 28 and the drill bit 14) and the weight of the piston member 100, and rod 102, in calculating the total downward load opposing the upward force. In a vertical configuration, assuming that the cylindrical housing 16 weighs 800 pounds, then the net upward pressure from the tool 12 exerted against the weight control device 10 would be 3,760 pounds (180 psi working pressure). Assuming that the piston member 100 and rod 102 weigh approximately 150 pounds, then the net force required would be slightly greater than 3,610 pounds, but less than 3,810 pounds. Assuming a working pressure of 180 psi then the upper face surface 108 should have an effective area of 20.056 square inches or slightly greater to create a downward force of slightly greater than 3,610 lbs.

It should be noted that should the working pressure change, the upward force created in the tool 12 would change proportionately. Likewise the downward force created in the cylindrical cavity 94 against the piston member 100 would change proportionately so that the weight control device 10 is capable of responding to changing working pressures to maintain the desired small net weight exerted on the drill bit 14.

In an alternate arrangement the direction of the piston member 100 and the casing member 86 in the weight control device 10 may be reversed so that the piston is directed upward and the casing is directed downward to create the necessary pressure differential.

The stroke of the piston member 100 within the cylindrical cavity 94 enables the weight control device 10 to adjust readily to changing feed rates. However, should a mismatch in feed rates occur for a substantial period, then the weight control device 10 will automatically signal to the operator that a substantial mismatch has occurred. Should the feed rate of the drill string 78 exceed the penetration rate of the drill bit 14 then the piston member 100 will move upward progressively closing off the main ports 120. As this occurs, the pressure through the drill spring 78 upward to the drill rig 80 will increase indicating to the operator that the feed rate of the drill string 78 is faster than the penetration rate. When the piston member 100 covers the main ports 120, the working pressure to the tool is decreased so as to substantially terminate the operation of the drilling tool 12 until the feed rate of the drill string is corrected. However, sufficient air is bled through the bleed ports 122 to maintain the tool 12 purged with air so as to prevent water, mud, etc., from backing into the tool 12.

Should the feed rate of the drill string 78 be substantially less than the penetration rate of the drill string 78 then the piston member 100 will move downward in the cylindrical cavity 94 to the lower extreme position. In this position the piston member 100 engages the retaining ring 112 substantially rigidly connecting the piston member to the casing member 86. When this occurs the vibration of the tool 12 is transmitted uphole through the drill string and would be noticed by the operator. The operator can then adjust the feed rate to increase the drill string feed rate to overcome the deficiency.

Consequently, one can appreciate that the downhole weight control device 10 automatically compensates for varying working pressures to maintain a small net positive load on the drill bit 14 which substantially increases the life of the drill bit 14 and decreases breakage of the carbide buttons 44. Additionally, the weight control device 10 provides a means of isolating the vibration of the tool from being transmitted up the hole which in turn substantially increases the life of the drilling equipment, particularly the drill string, the drill swivel, the drill rotary table, the power heads and the drill feed systems. Furthermore, straighter holes are formed. Also, operators with less experience may be utilized because of the automatic control of the weight.

It should be understood that references to directions such as "downward" and "upward" are used for descriptive purposes and other terms such as forward and rearward may in certain conditions be more appropriate. Additionally it should be understood that the above-described embodiment is simply illustrative of the features of this invention and numerous other embodiments may be readily devised without deviating therefrom. Therefore, only the following claims are intended to define this invention.

What is claimed is:

1. A downhole weight device for attaching to a downhole, pneumatically-operated impact rock drilling tool having a drill bit to automatically maintain the drill bit in low value pressure contact with the bottom of the hole irrespective of the depth of the hole and the working pressure to enable the tool to operate at optimum penetration efficiency while minimizing breakage and excessive wear of the drill bit, in which the impact drilling tool has:

an elongated tool housing extending between an upper end and a lower end with an enclosed internal tool cylinder chamber therebetween;

said lower end of the tool housing having a chuck for receiving and securing the drill bit thereto with the drill bit permitted limited free movement with respect to the tool housing between a closed working position and an extended nonworking position;

a hammer piston freely mounted in the cylinder chamber for moving downward toward and impacting against the drill bit;

said hammer piston having an upper face surface of a known area;

wherein the downhole weight device comprises:

an elongated cylindrical casing member having a cylindrical cavity therein;

a weight control piston member mounted for reciprocal movement within the cylindrical cavity;

first connecting means for operatively connecting one of the members to an uphole drill string;

a second connecting means for operatively connecting the other member to the upper end of the tool housing;

device air supply means for applying air at the working air pressure (1) to the tool cylinder chamber and against the upper face surface of the hammer piston to drive the hammer piston downward toward and against the drill bit and against the elongated tool housing creating an upward force related to the known area of the upper piston face tending to lift the tool housing with respect to the tool bit with the tool bit tending to move from the closed position toward the extended nonworking position, and (2) to the device cylindrical cavity and against a face surface of the weight control piston member for generating a downward force through the second connecting means applied to the tool housing to oppose the upward force tending to lift the tool housing;

wherein said face surface of the weight control piston member has a surface area related to the known area of the upper face surface of the hammer piston so that the downward force is sufficient to prevent the tool housing from lifting with respect to the drill bit and to maintain the drill bit in the closed working position with the drill bit in low value operating contact pressure with the bottom of the hole;

wherein the weight control piston member is reciprocally mounted in the elongated cylindrical cavity for movement to a contracted position when the drill string is fed downward at a substantially greater rate than the penetration rate of the drilling bit and to an extended position when the penetration rate of the drilling bit is substantially greater than the feed rate of the drill string; and automatic air pressure decreasing means responsive to the contraction of the tool for automatically decreasing the air pressure against the hammer piston and the weight control piston when the weight control piston member approaches the contracted position to cause an increase in back pressure up the drill string and to reduce the applied downward force on the tool housing to minimize the contact pressure of the drill bit with the bottom of the hole when the drill string is fed downward at a substantially greater rate than the penetration rate of the drilling bit.

2. The downhole weight control device as defined in claim 1 wherein the face surface area of the weight control piston member is substantially equal to the preset area of the upper face surface of the hammer piston.

3. The downhole weight control device as defined in claim 1 wherein the face surface area of the weight control piston member is selected so that the downward force plus the weight of the tool housing and the other device member is slightly greater than the upward force to maintain the drill bit in the closing working position.

4. The downhole weight control device as defined in claim 1 wherein the automatic air pressure decreasing means includes main air ports formed in a wall of the cylindrical cavity adjacent the contracted position for normally emitting air at the working pressure into the cylindrical cavity and wherein the weight control piston member covers the air ports when the weight control piston member is in the contracted position to decrease the air pressure against the hammer piston and against the weight control piston member.

5. The downhole weight control device as defined in claim 4 wherein the device air supply means includes a bleed passageway for bleeding a small amount of air through the weight control device to the drilling tool when the weight control piston member is in the contracted position covering the main air ports to purge the drilling tool to prevent foreign material from entering the drilling tool.

6. The downhole weight control device as defined in claim 4 wherein the weight control piston member has an unrestricted central bore therethrough operatively communicating with the tool air supply means for passing air at the working pressure from the weight control device to the drilling tool.

7. The downhole weight control device as defined in claim 1 wherein the second connecting member is formed integrally with the control piston member and is provided means for directly connecting to the upper end of the tool housing.

* * * * *